United States Patent [19]

Collins, Jr.

[11] Patent Number: 4,953,480

[45] Date of Patent: Sep. 4, 1990

[54] ROTARY WATERWALL COMBUSTOR WITH IMPROVED TIRE ATTACHMENT

[75] Inventor: William G. Collins, Jr., Greensburg, Pa.

[73] Assignee: Westinghouse Electric Corp., Pittsburgh, Pa.

[21] Appl. No.: 387,672

[22] Filed: Jul. 31, 1989

[51] Int. Cl.[5] ..... A47J 36/00

[52] U.S. Cl. ..... 110/246; 110/226; 432/103; 432/251; 51/164.1

[58] Field of Search ..... 110/246, 226; 432/103, 432/104, 251; 259/81 R; 241/183, 181; 51/163.1, 164.1

[56] References Cited

U.S. PATENT DOCUMENTS

| | | | |
|---|---|---|---|
| 2,877,007 | 3/1959 | Risse | 432/103 |
| 3,317,202 | 5/1967 | Cates, Jr. et al. | 432/103 |
| 3,918,893 | 11/1975 | Whitaker | 432/103 |
| 4,226,584 | 10/1980 | Ishikawa | 110/246 |
| 4,542,703 | 9/1985 | Przewalski | 110/226 |
| 4,765,255 | 8/1988 | Chiarva | 110/246 |

FOREIGN PATENT DOCUMENTS

| | | | |
|---|---|---|---|
| 808814 | 3/1981 | U.S.S.R. | 432/103 |

*Primary Examiner*—Henry A. Bennet
*Assistant Examiner*—Denise L. Ferensic

[57] ABSTRACT

An improved attachment for positioning a rotary waterwall combustor within a tire so it rotational axis is fixed and the rotary waterwall combustor, the tire and the attachment linkage are free to expand independently without inducing stresses due to differential thermal expansion; the attachment linkage comprises a plurality of support blocks attached to the rotary waterwall combustor and a plurality of support lugs attached to the tire with a plurality of links pivotally connected to the blocks and lugs with an elongated opening cooperatively associated with one of the pivotal connections to allow pivotal and axial movement and eliminate stresses caused by differential thermal expansion.

12 Claims, 5 Drawing Sheets

ROTARY WATERWALL COMBUSTOR WITH IMPROVED TIRE ATTACHMENT

BACKGROUND OF THE INVENTION

The invention relates to a municipal waste incinerator and more particularly to an improved attachment between a rotary waterwall combustor and the tires upon which it rotates.

Metal plates are presently utilized to attach the rotary combustor barrel to support tires upon which it rotates. There is a tire near each end of the combustor The tires rest on rollers. The weight of the combustor, including the water in the water tubes and the solid fuel within the combustor is carried through the attachments plates to the tires and to the rollers. The combustor is caused to rotate by a drive system, which causes the solid fuel within to tumble and travel along the length of the combustor while burning Rollers support the tires and enable the combustor to rotate. During normal operation, the combustor barrel, which is made of steel boiler tubes interconnected with steel webs, is at elevated temperature of approximately 500° F.. When idle the temperature will drop to ambient, 0 to 100° F. The combustor thus undergoes significant thermal expansion between idle and normal operating conditions. The attachments of the combustor to the tire must accommodate this expansion The metal plates that make the attachment accommodate the expansion by bending in the direction of the radius of the combustor, which is perpendicular to the plane of the plates. The support plates are made thin enough to accommodate the bending without experiencing excessive stress, in the manner of flat springs and are customarily referred to as support springs. It is important for the axis of the combustor to remain in essentially the same position whether it is idle or operating in order to avoid excessive stresses on the piping and fittings that convey circulating water between the rotating combustor and the stationary boiler and pumps that are connected to the combustor.

The problem with the spring support design is it results in an indeterminate structure that cannot be readily analyzed, and a structure that may be subject to fatigue failure that would shorten it useful life. Thermal expansion of the support springs themselves and deformation of the tire under load puts the springs in compression, and this compression together with the load due to bending of the support spring and the weight of the combustor and waste being burned can result in very high stresses, which would be partially cyclic. The analysis of this support system is difficult and unreliable and thus the system is subject to premature failure.

SUMMARY OF THE INVENTION

Among the objects of the invention may be noted the provision of a support system which is easy to analyze, is not subject to stresses induced by differential thermal expansion, is not highly stressed and will maintain the rotational axis of the rotary combustor in a fixed position.

In general, an improved tire attachment, when made in accordance with this invention, comprises a plurality of improved attachments connecting a rotary waterwall combustor to a tire, each of said improved attachments comprising a support block attached to said rotary waterwall combustor and a linkage pivotally connecting said support block to said tire so as to support said rotary waterwall combustor within said tire, maintain the position of the central axis of the rotary waterwall combustor and provide for differential thermal expansion of the rotary waterwall combustor, the pinned linkage and the tire.

BRIEF DESCRIPTION OF THE DRAWINGS

The invention as set forth in the claims will become more apparent by reading the following detailed description in conjunction with the accompanying drawings, wherein like reference numerals refer to like parts through the drawings and in which:

DESCRIPTION OF THE PREFERRED EMBODIMENT

Figure 1:
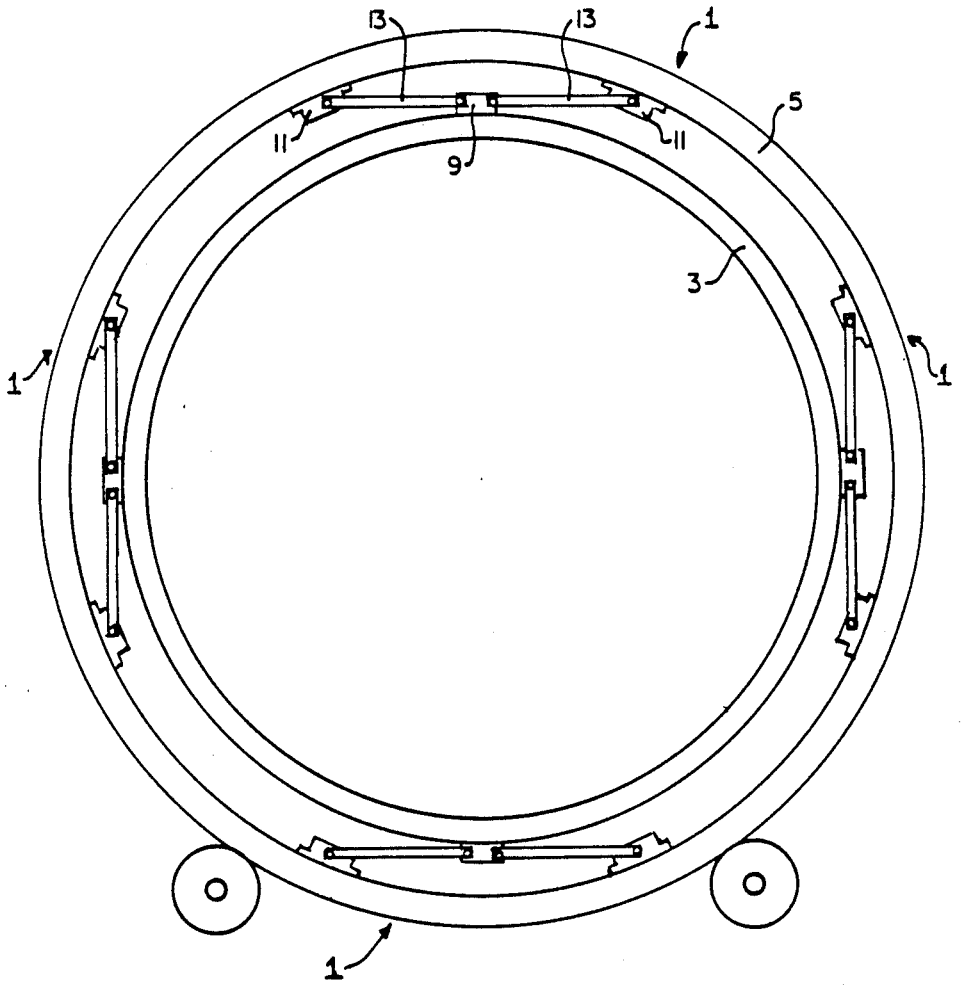
FIG. 1 is a schematic sectional view of a water wall rotary combustor at the location of a tire and rollers upon which the combustor rotates and shows improved attachments between the combustor and the tire.

Referring now to the drawings in detail and in particular to FIG. 1 there is shown a schematic drawing of an attachment generally indicated at 1 between a rotary waterwall combustor 3, shown schematically as a circular ring, disposed within a tire 5, shown as an outer ring, with a plurality of improved attachments 1 disposed to connect the rotary waterwall combustor 3 to the tire 5 in such a manner as to maintain a fixed central axis of rotation of the rotary waterwall combustor 3 and provide for differential thermal expansion of the rotary waterwall combustor, the tire 5 and the attachments 1. Each of the attachments 1 comprise a support block 9 rigidly affixed to the rotary waterwall combustor 3 and a linkage pivotally connecting the support block 9 to the tire 5. The linkage comprises a pair of support lugs 11 affixed to the tire 5 and a pair of links 13 pivotally connected to the support block 9 adjacent one distal end and pivotally connected to the support lugs 11 adjacent the opposite distal ends. This hinge like attachment of each end of the link 13 to the tires and the combustor 3 allows unrestrained expansion of the waterwall combustor 3 without imposing any bending stresses on the links 13. Therefore, the links 13 can be made as thick and strong as necessary to carry the weight of the waterwall combustor 3 with no need to compromise to accommodate bending.

Figure 2:
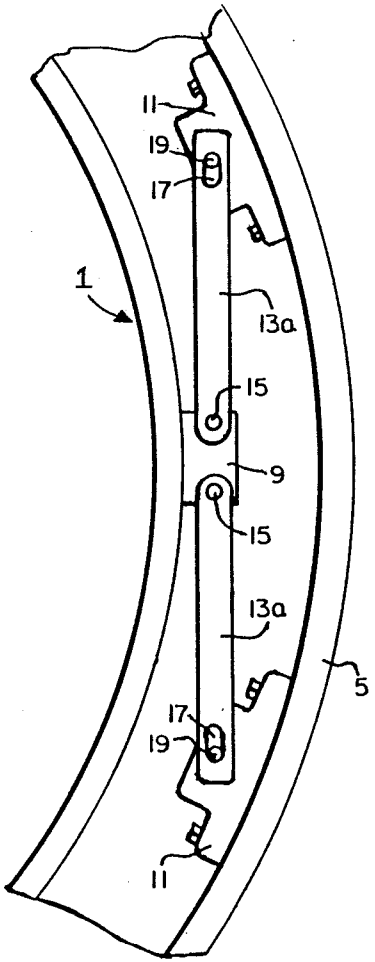
FIG. 2 is an enlarged partial sectional view of an attachment between the combustor and the tire when cold.

FIG. 2 shows links **13*a* pivotally connected to the support block 9 by a pair of pins 15 and having an elongated opening 17, which cooperates with a pin 19 to pivotally connect the links 13*a* to the support lugs 11. The elongated openings 17 are so disposed that the pins 19 are snug against the outer or distal end of the openings when the waterwall combustor 3 is cold. This allows axial movement of the links 13*a* with respect to the pins 19 and provides for differential thermal expansion of the rotary waterwall combustor 3, the tire 5 and the links 13*a* without introducing stresses and still maintains a fixed axis of rotation for the rotary waterwall combustor 3. The elongated holes or openings 17 eliminate compressive loads in the link 13*a*, which arise from thermal expansion and deformation of the tire 5. Thus, the links 13***a* carry the weight of the waterwall combustor 3 in tension only, making the structure easier to analyze and eliminates compression loads on the links 13*a*. As the system heats up the waterwall combustor 3 heats up more than the links 13*a*, which in turn heat up more than the tires 5 The waterwall combustor 3 expands more than the tires 5. The links 13*a* expand more than the tires 5 and hence the length of the links 13*a* will increase more than the distance between the attachment holes in the support lugs 11 affixed to the tire 5. The elongated holes 17 in the links 13*a* allow the links 13*a* to expand without constraint, and hence without being subject to compressive stress. The ends of the holes 17 are so disposed as to achieve a snug fit when cold. Thus, the links 13*a* nearest the horizontal axis of the waterwall combustor 3 carrying the weight of the waterwall combustor 3 in tension in the upper links 13*a* as they are close to vertical and the lower links 13*a* will hang with out compression. The axis of rotation of the waterwall combustor 3 will be maintained in its correct position.

Figure 3:
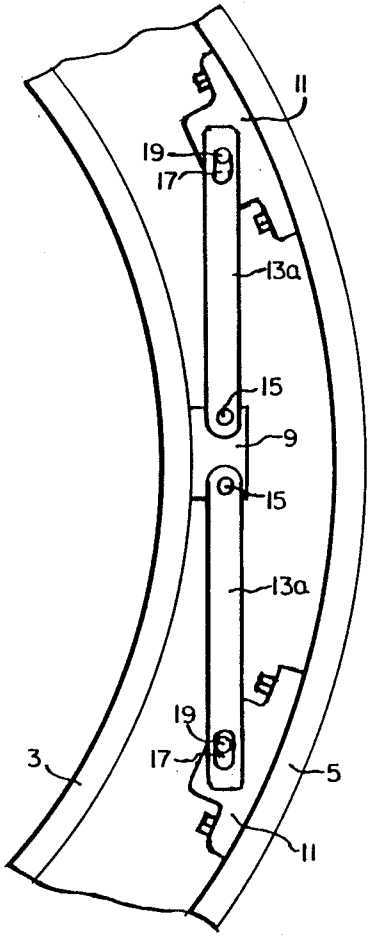
FIG. 3 is the same enlarged partial sectional view of an attachment between the combustor and the tire when hot.

FIG. 3 is the same as FIG. 2 except it shows the unit heated so that the rotary combustor 3 and tire 5 have expanded, as has the links 13*a*. However, the elongated openings 17 are sufficiently long that even after thermal expansion the link 13*a* not carrying the weight of the combustor is hanging free and there is a slight clearance between the upper end of the elongated opening 17 and the pin 19 in the free link 13*a*.

Figure 4:
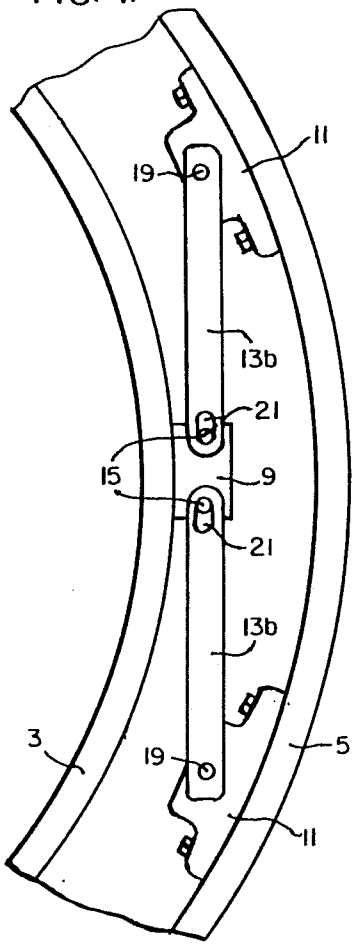
FIGS. 4 through 10 are enlarged partial sectional views of alternative attachments between the combustor and the tire.

In FIG. 4, links 13*b* have an elongated opening 21 disposed on the distal ends adjacent the support block 9, which cooperate with pins 15 to pivotally connect the links 13*b* to the support block 9. The elongated openings 21 allow axial movement of the links 13*b* relative to the pins 15 to provide for differential thermal expansion of the rotary waterwall combustor 3, the tire 5, and the links 13*b* without introducing thermal induced stresses and still maintaining a fixed axis of rotation of the rotary combustor 3.

Figure 5:
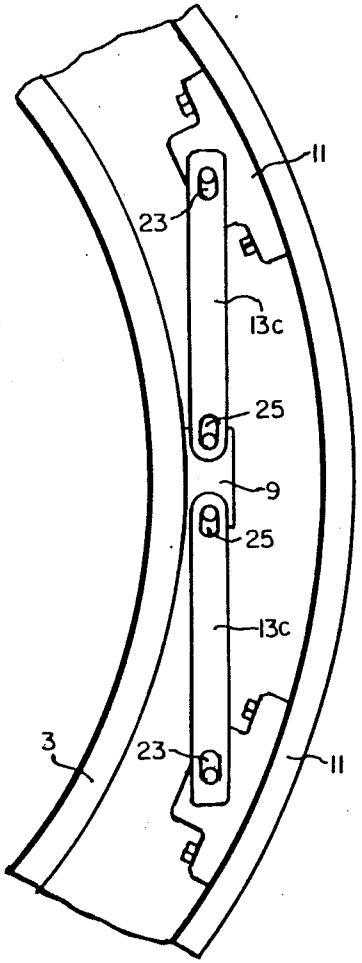

As shown in FIG. 5, both ends of the links 13*c* can have elongated openings 23 and 25, however they need not be as long as the elongated openings 17 and 21.

Figure 6:
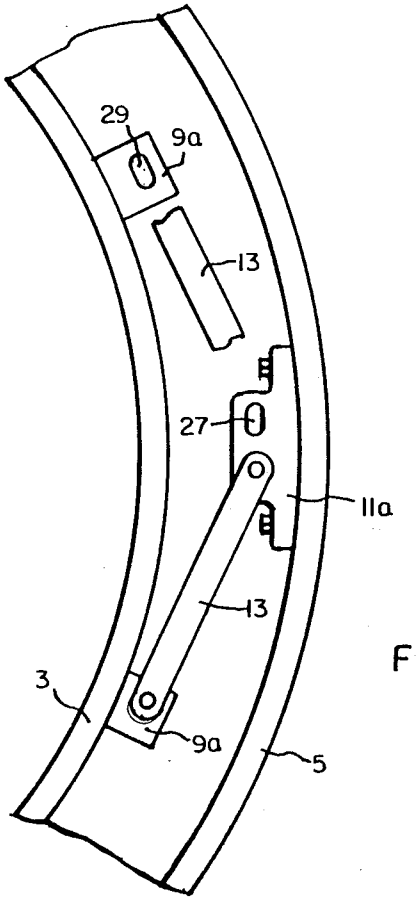

FIG. 6 shows a pair of support blocks 9*a* attached to the rotary waterwall combustor 3 having an elongated opening 27 and a single support lug 11*a* attached to the tire 5 with a pair of elongated openings 29 disposed therein, however, only one is visible. The elongation of the openings 27 and 29 is in a direction away from the central portion of the link 13 so that the link 13 can increase its length as it heats up without restraint. While both elongated openings 27 and 29 are shown, it is understood that either one or the other could be utilized and the single elongated opening 27 or 29 would be slightly longer in a direction away from the center of the link 13.

Figure 7:
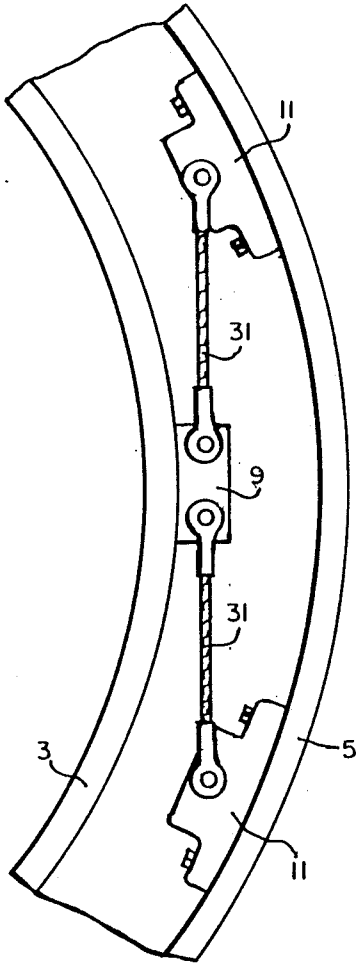
Figure 8:
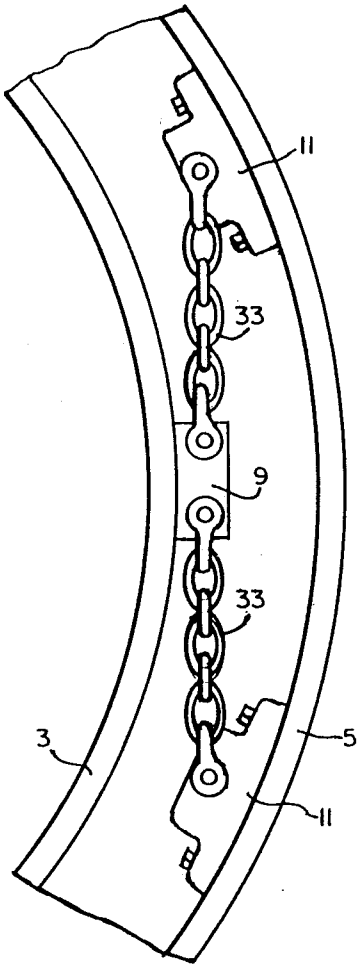

Alternatively, as shown in FIGS. 7 and 8, flexible links 31 and 33 could be utilized to eliminate all compressive forces in the links 31 and 33. The links 31, shown in FIG. 6, are formed of wire rope and the links 33, shown in FIG. 7, are formed of chain, each with appropriate end connectors to pivotally connect them to the support block 9 and lugs 11.

Figure 9:
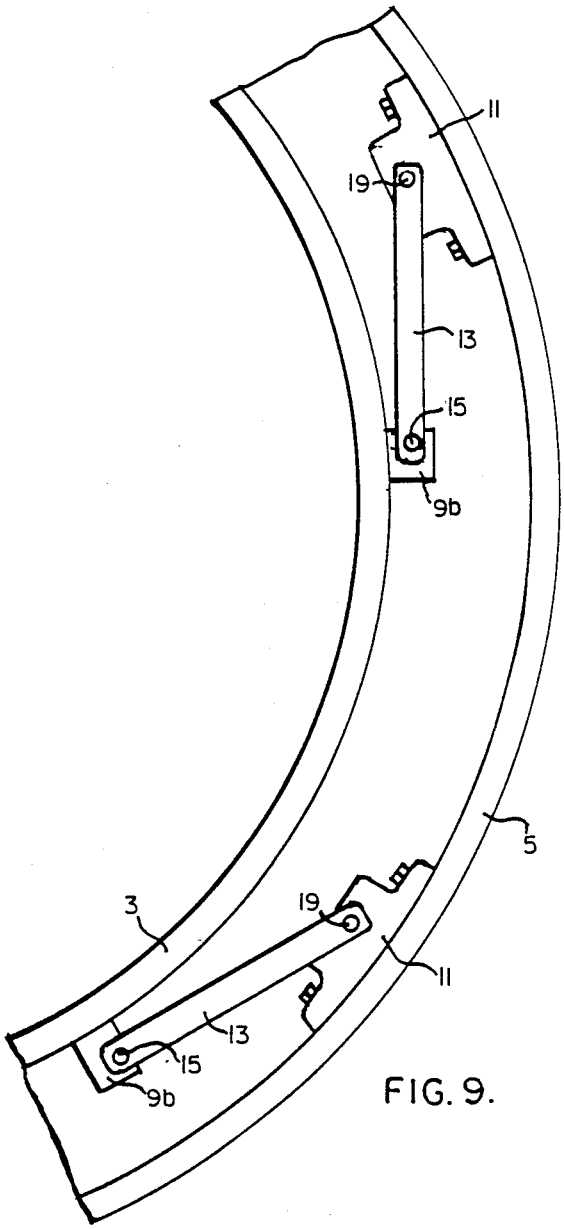

In FIG. 9, each support block 9*b* is pivotally connected to a single support lug 11 by the link 13 and pins 15 and 19. Neither the openings in the link 13, nor in the support block 9*b* or support lug 11 are elongated and yet this attachment allows for thermal differential expansion of the rotary waterwall combustor 3, the tire 5, the links 13 and the support blocks 9 and lugs 11 and maintains the fixed axis of rotation of the rotary waterwall combustor 3.

Figure 10:
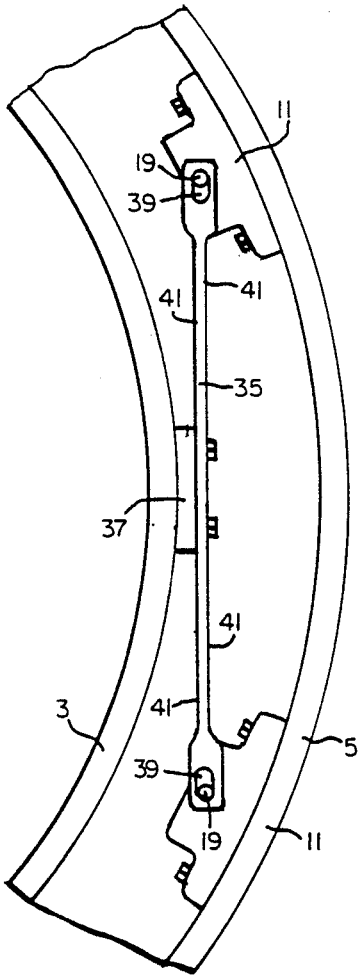

FIG. 10 shows a single link 35 rigidly attached to a support block 37 and pivotally attached to a pair of support lugs 11 by the pins 19 which cooperates with elongated openings 39 disposed on the distal ends of the link 35 to provide for differential thermal expansion of the rotary waterwall combustor 3, the tire 5 and the link 35 and support block 37 and lugs 11 and maintain the essentially fixed location of the axis of the rotary waterwall combustor 3 without inducing compressive stresses in the link 35. The link 35 has a central portion, which is generally in the shape of a flat bar with its major surfaces 41 disposed generally parallel to a line tangent to the rotary waterwall combustor 3 to permit the link 35 to bend and act as a flat spring, but the elongated openings 39 prevent the induction of compression stresses due to thermal expansion of any of the associated elements. This embodiment is similar to the type of attachment used in existing waterwall combustors, with the addition of elongated openings 39 for the attachment pins 19. As in the other embodiments, the elongated openings 39 could be placed in the ends of the link 35, as shown, or in the support lugs 11. The elongated holes 39 are sized to be snug when cold and allow for thermal expansion without producing compressive stresses in the links 35 when heated to operating temperatures.

While the preferred embodiments described herein set forth the best mode to practice this invention presently contemplated by the inventor, numerous modifications and adaptations of this invention will be apparent to others skilled in the art. Therefore, the embodiments are to be considered as illustrative and exemplary and it is understood that numerous modifications and adaptations of the invention as described in the claims will be apparent to those skilled in the art. Thus, the claims are intended to cover such modifications and adaptations as they are considered to be within the spirit and scope of this invention.

What is claimed is:

1. A plurality of improved attachments connecting a rotary waterwall combustor to a tire, each of said improved attachments comprising a support block attached to said rotary waterwall combustor, a linkage, a pin arrangement pivotally connecting said support block to said tire and elongated openings cooperating with said pin arrangement so that only tensile forces are transmitted through said linkage and pin arrangement to support said rotary waterwall combustor within said tire, maintain the position of the central axis of the rotary waterwall combustion and provide for differential thermal expansion of the rotary waterwall combustor, the linkage and the tire.

2. The improvement attachment of claim 1, wherein said pivotally connected linkage comprises a pair of links pivotally connected to said support block and said tire and one of the pivotal connections associated with each link has cooperatively associated therewith an elongated opening and pin arrangement which only transmits tensile forces.

3. The improved attachment of claim 2, wherein said pivotally connected linkage comprises a pair of support lugs attached to the tire and each of the support lugs is pivotally connected to one of the links.

4. The improved attachment of claim 1, wherein said pivotally connected linkage comprises a pair of support lugs attached to said tire; a pair of links pivotally connected to said support block and pivotally connected to said support lugs.

5. The improved attachment of claim 4 wherein each link has a pin arrangement which cooperates with an elongated opening in each link to allow only the transmission of tensile force through said links.

6. The improved attachment of claim 4, wherein said support block has a pair of elongated openings to allow only the transmission of tensile force through said links.

7. The improved attachment of claim 4, wherein said support lugs each have an elongated opening to allow only the transmission of tensile forces through said links.

8. The improved attachment of claim 4, wherein said block and said lugs each have said elongated openings disposed therein.

9. The improved attachment of claim 4 wherein said links each have elongated openings disposed in the distal ends thereof.

10. A plurality of improved attachments connecting a rotary waterwall combustor to a tire, each of said improved attachments comprising a support block attached to said rotary waterwall combustor, a pair of support lugs and flexible linkage means for transmitting only tensil forces, said flexible linkage means to support said rotary waterwall combustor within said tire, maintain the position of the central axis of the rotary waterwall combustor and provide for differential thermal expansion of the rotary waterwall combustor, the linkage means and the tire.

11. The improved attachment of claim 10, wherein said flexible linkage means comprise a wire rope.

12. The improved attachment of claim 10, wherein said flexible linkage means comprise a chain.

* * * * *